US006443797B1

(12) United States Patent
Liu

(10) Patent No.: US 6,443,797 B1
(45) Date of Patent: Sep. 3, 2002

(54) BUILT-UP TOY CAR ROTATABLE WHEELS

(76) Inventor: Kuo-Ching Liu, 5Fl., No. 11, Alley 1, Sec. 1, Lane 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 09/951,977

(22) Filed: Sep. 14, 2001

(51) Int. Cl.[7] ..... A63H 17/00
(52) U.S. Cl. ..... 446/93; 229/103
(58) Field of Search ..... 446/93, 94, 95, 446/102, 388, 387, 61–63; 229/102; 217/12 R; D21/552, 558, 548, 490; 434/300

(56) References Cited

U.S. PATENT DOCUMENTS 1,574,191 A * 2/1926 Groves
1,923,881 A * 8/1933 Palais
1,932,368 A * 10/1933 Bowman
3,161,986 A * 12/1964 Stubbmann et al.
4,807,802 A * 2/1989 Williams ..... 229/23 R
5,775,917 A * 7/1998 Louviere ..... 434/300

* cited by examiner

*Primary Examiner*—Derris H. Banks
*Assistant Examiner*—Jamie Williiams
(74) *Attorney, Agent, or Firm*—Troxell Law Office PLLC

(57) ABSTRACT

A built-up toy car includes a body, and a front-wheel assembly and a rear-wheel assembly connected to lower front and lower rear ends, respectively, of the body. Both the front and the rear wheel assemblies include a flat axle part supported in two open-bottomed axle holes provided at the lower front and the lower rear ends, respectively, of the body, and two flat wheel parts connected to two ends of the axle part. Each of the axle parts is provided at upper and lower edges at positions engaging with the axle holes with two pairs of upper and lower notches to form thereat a reduced width slightly smaller than the axle holes, so that the axle parts of the front and the rear wheel assemblies are rotatable in the axle holes relative to the body of the toy car.

4 Claims, 3 Drawing Sheets

BUILT-UP TOY CAR ROTATABLE WHEELS

FIELD OF THE INVENTION

The present invention relates to a toy car built up from a plurality of flat parts, and more particularly to a built-up toy car with rotatable wheels. A front and a rear axle part of the built-up toy car are provided at upper and lower edges at positions engaging with axle holes provided at lower front end and lower rear end of the car, respectively, with two pairs of upper and lower notches of a predetermined depth to form thereat a reduced width slightly smaller than the axle holes, so that the front and the rear axle parts are rotatable in the axle holes relative to the body of the toy car.

BACKGROUND OF THE INVENTION

A conventional toy car built up from a plurality of flat parts usually includes a body, and a front and a rear wheel assembly connected to lower front and lower rear ends, respectively, of the body. The front and the rear wheel assemblies both include a flat axle part having two flat wheel parts connected to two ends thereof. The axle parts are engaged at an upper edge with slits provided at the lower front and the lower rear ends of the body and thereby connect the wheel assemblies to the body. The wheel assemblies connected to the body in this manner are not rotatable relative to the body. Thus, the conventional built-up toy car is only a toy suitable for seeing statically and is less interesting for playing.

It is therefore tried by the inventor to develop a built-up toy car with rotatable wheels to eliminate the drawback of the conventional built-up toy car.

SUMMARY OF THE INVENTION

A primary object of the present invention is to provide a built-up toy car with rotatable wheels, so that the wheels rotate to move the built-up toy car forward on a plane when a player pushes the toy car.

To achieve the above and other objects, the built-up toy car of the present invention mainly includes a body assembled from a plurality of flat parts, and a front-wheel assembly and a rear-wheel assembly connected to a lower front and a lower rear end, respectively, of the body. Both the front-wheel assembly and the rear-wheel assembly include a flat axle part supported in two open-bottomed axle holes provided at the lower front end and the lower rear end, respectively, of the body, and two flat wheel parts connected to two ends of each axle part. Each of the axle parts is provided at upper and lower edges at positions engaging with the axle holes with two pairs of upper and lower notches of a predetermined depth to form thereat a reduced width slightly smaller than an internal dimension of the axle holes, so that the axle parts are rotatable in the axle holes and thereby bring the front-wheel and the rear-wheel assemblies to rotate relative to the body and move the toy car forward on a plane when a player pushes the toy car.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
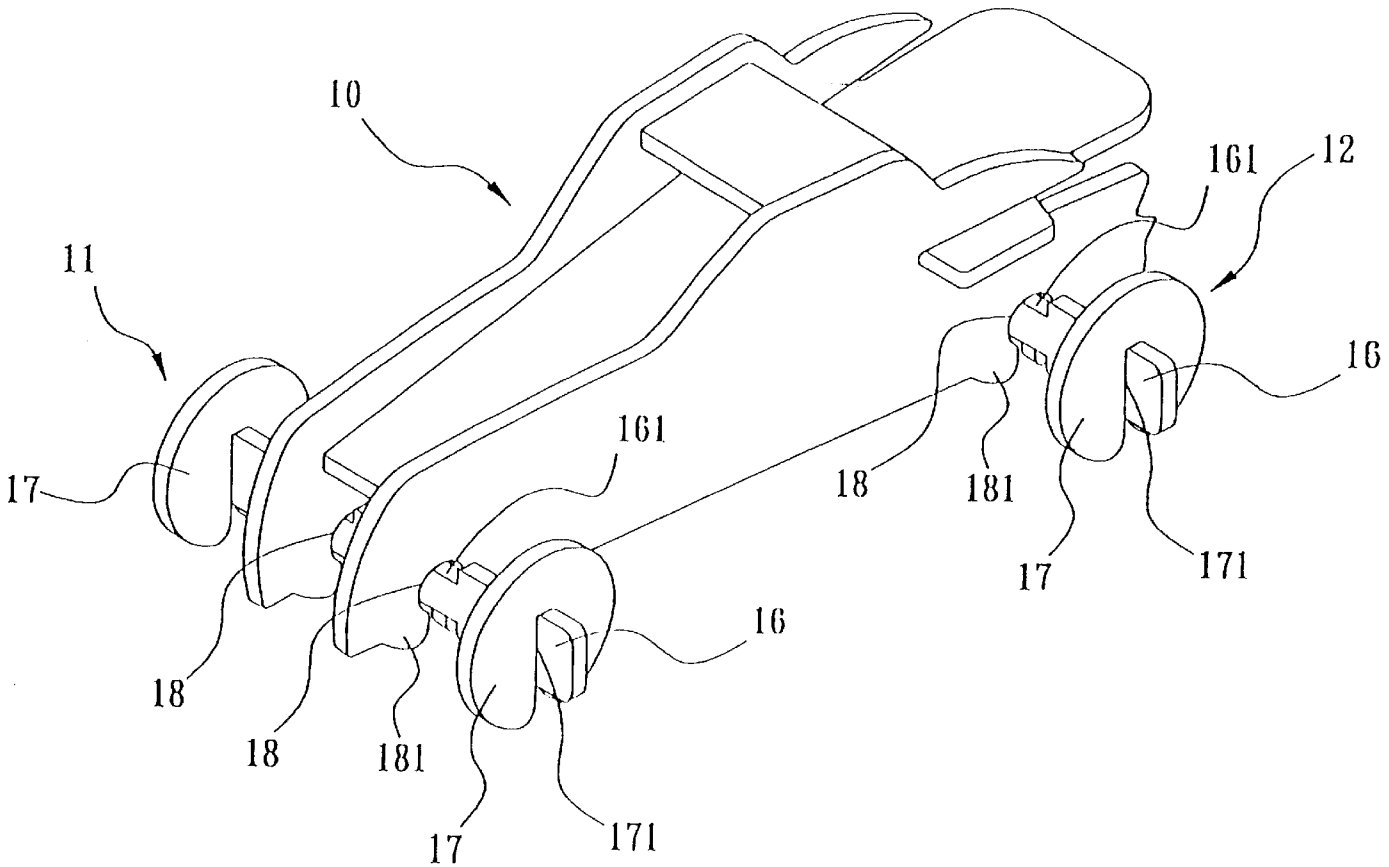
FIG. 1 is an assembled perspective view of a built-up toy car with rotatable wheels according to an embodiment of the present invention.
Figure 2:
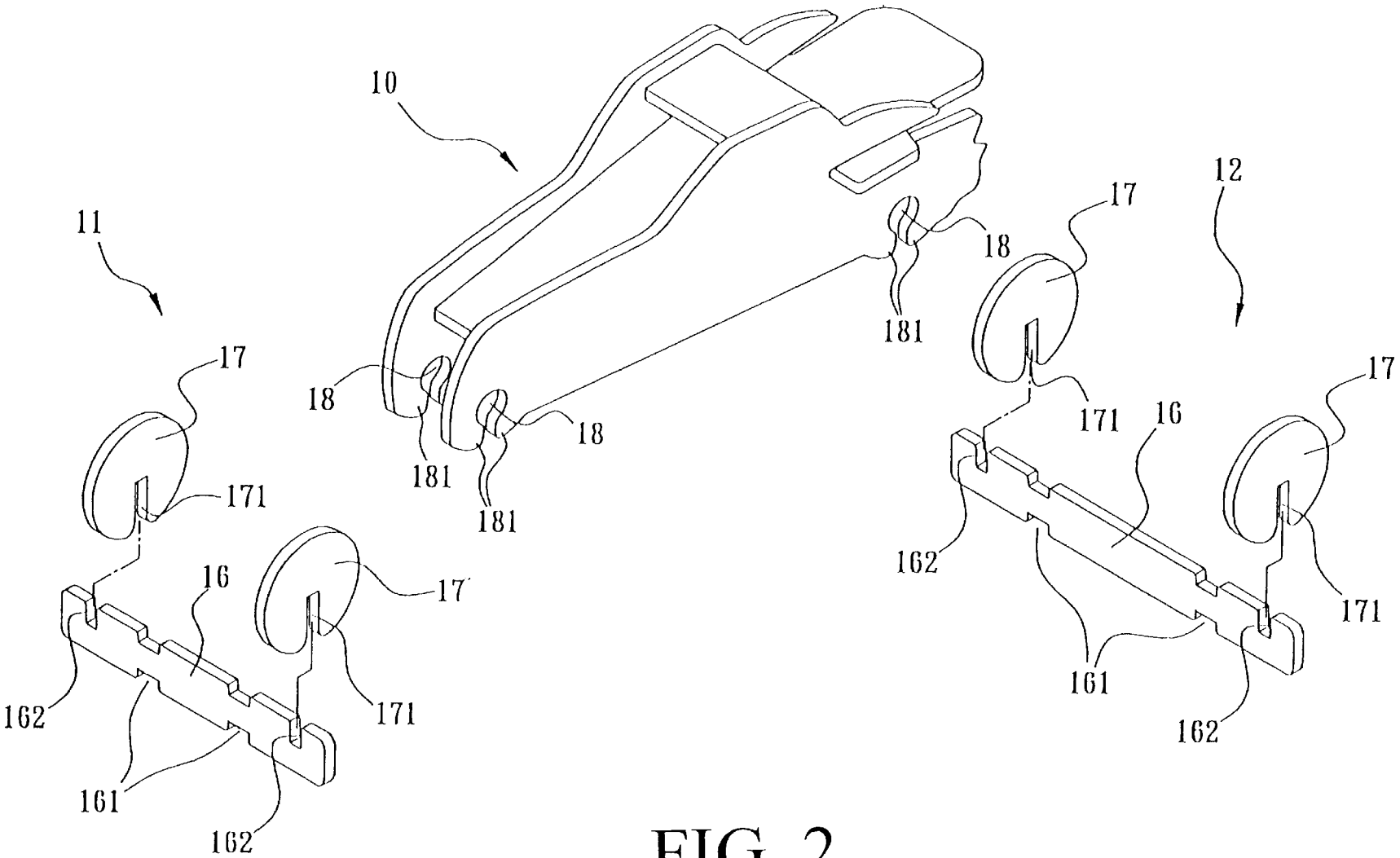
FIG. 2 is an exploded perspective view of FIG. 1.

Please refer to FIGS. 1 and 2 that are assembled and exploded perspective views, respectively, of a built-up toy car with rotatable wheels according to an embodiment of the present invention. As shown, the built-up toy car includes a body 10 assembled from a plurality of flat parts and has a front-wheel assembly 11 and a rear-wheel assembly 12 respectively connected to a front and a rear portion thereof.

Both the front-wheel assembly 11 and the rear-wheel assembly 12 include a flat axle part 16 and two flat wheel parts 17 separately connected to two ends of the axle part 16.

Each of the axle parts .16 is provided at upper and lower edges at positions intended for engaging with the body 10 with two pairs of upper and lower notches 161 having a predetermined depth, so that a width of each axle part 16 at the positions having the notches 161 is reduced.

Figure 3:
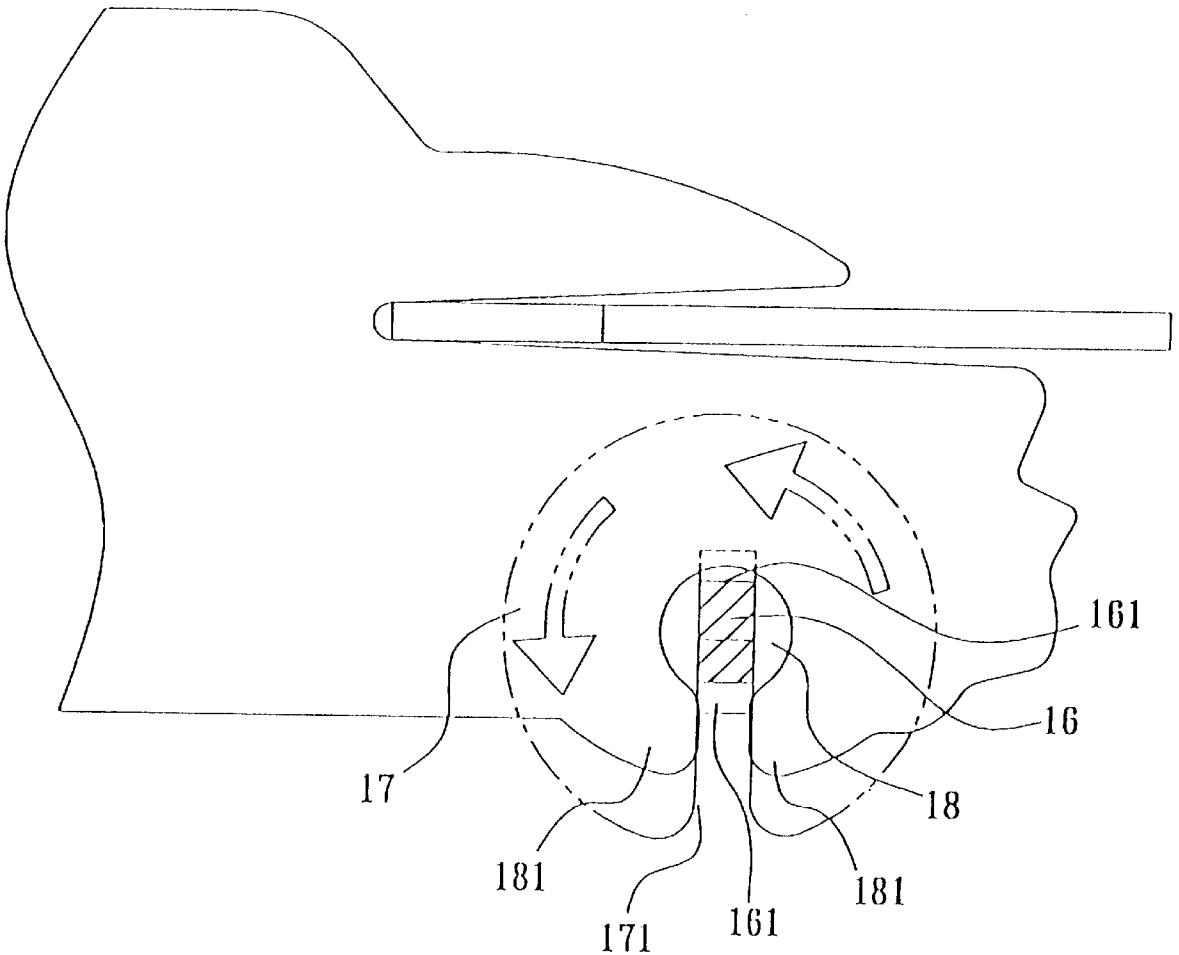
FIG. 3 is a fragmentary, enlarged and partially sectioned side view of the toy car of FIG. 1 showing the manner in which the wheel assembly thereof rotates.

Please refer to FIG. 3. Both a lower front end and a lower rear end of the body 10 are provided at positions for engaging with the axle parts 16 with two open-bottomed axle holes 18. The front-wheel and the rear-wheel assemblies 11, 12 are connected to the lower front and the lower rear ends, respectively, of the body 10 by engaging the two pairs of notches 161 of their respective axle parts 16 with corresponding open-bottomed axle holes 18. By making the reduced width of each axle part 16 at the two pairs of upper and lower notches 161 slightly smaller than an internal dimension of each axle hole 18, the axle parts 16 are rotatable in the axle holes 18 relative to the body 10.

Please refer to FIG. 2. In the illustrated embodiment of the present invention, the axle holes 18 are round in shape. Portions of the body 10 at two sides of a bottom opening defined by each open-bottomed axle hole 18 extend toward each other to form two projections 181. The projections 181, due to their dimensions, provide a certain extent of flexibility that enables the axle parts 16 of the front-wheel and the rear-wheel assemblies 11, 12 to rotatably mount in the axle holes 18 without easily separating therefrom.

Please refer to FIGS. 1 and 2 again. Each axle part 16 of the front-wheel and the rear-wheel assemblies 11, 12 is provided at outer sides of the two pairs of upper and lower notches 161 with two first wheel slits 162, and each of the wheel parts 17 is provided at a predetermined position with a second wheel slit 171. By engaging the second wheel slits 171 with the first wheel slits 161, the wheel parts 17 are connected to the axle parts 16.

With the above arrangements, a player may push the built-up toy car of the present invention forward on a plane with the front-wheel and the rear-wheel assemblies 11, 12 rotating relative to the body 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A built-up toy car with rotatable wheels, comprising:

a body being assembled from a plurality of flat parts;

a front-wheel assembly being connected to a lower front portion of said body and including a flat front axle part, and two flat front wheel parts separately connected to two outer ends of said front axle part; said front axle part being provided at upper and lower edges at positions intended for engaging with said body with two first pairs of upper and lower notches having a predetermined depth and therefore having a reduced width at said positions having said notches; and said front axle part being connected to said body by engaging said two first pairs of notches with two open-bottomed front axle holes that are provided at a lower front end of said body and have an internal dimension slightly larger than said reduced width of said front axle part, so that said front axle part is rotatable in said front axle holes relative to said body; and a rear-wheel assembly being connected to a lower rear portion of said body and including a flat rear axle part, and two flat rear wheel parts separately connected to two outer ends of said rear axle part; said rear axle part being provided at upper and lower edges at positions intended for engaging with said body with two second pairs of upper and lower notches having a predetermined depth and therefore having a reduced width at said positions having said notches; and said rear axle part being connected to said body by engaging said two second pairs of notches with two open-bottomed rear axle holes that are provided at a lower rear end of said body and have an internal dimension slightly larger than said reduced width of said rear axle part, so that said rear axle part is rotatable in said rear axle holes relative to said body;

whereby said built-up toy car could be pushed forward on a plane with said front-wheel and said rear-wheel assemblies rotating in said front and said rear axle holes, respectively, relative to said body.

2. The built-up toy car with rotatable wheels as claimed in claim 1, wherein said open-bottomed front and rear axle holes are round in shape.

3. The built-up toy car with rotatable wheels as claimed in claim 2, wherein each of said open-bottomed front and rear axle holes defines a bottom opening, and portions of said body at two sides of each said bottom opening extend toward each other to form two projections with a certain extent of flexibility that enables said front and said rear axle parts to rotatably mount in said front and said rear axle holes, respectively, without easily separating herefrom.

4. The built-up toy car with rotatable wheels as claimed in claim 1, wherein said front and said rear axle parts are provided at positions intended for connecting said front and said rear wheel parts, respectively, with two first wheel slits, and each of said front-wheel and said rear-wheel parts being provided with a second wheel slit corresponding to said first wheel slits, so that said front-wheel and said rear-wheel parts are connected to said front and said rear axle parts, respectively, by engaging said second wheel slits with said first wheel slits.

* * * * *